US008215224B1

(12) United States Patent
Tortorici, Jr. et al.

(10) Patent No.: US 8,215,224 B1
(45) Date of Patent: Jul. 10, 2012

(54) VARIABLE RECOIL BRAKE FOR MUNITION

(75) Inventors: Richard W. Tortorici, Jr., Schenectady, NY (US); Ronald Gast, Cohoes, NY (US); Edward Hyland, Waterford, NY (US); Richard W. Tortorici, III, Cohoes, NY (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 64 days.

(21) Appl. No.: 12/549,794

(22) Filed: Aug. 28, 2009

Related U.S. Application Data

(63) Continuation-in-part of application No. 11/425,812, filed on Jun. 22, 2006, now abandoned.

(51) Int. Cl.
*F41A 25/02* (2006.01)

(52) U.S. Cl. ..... 89/43.01; 89/198

(58) Field of Classification Search ..... 89/42.01, 89/42.02, 42.03, 43.01, 43.02, 177, 198; 188/283, 283.1
See application file for complete search history.

(56) References Cited

U.S. PATENT DOCUMENTS

| | | | | | |
|---|---|---|---|---|---|
| 500,908 | A | * | 7/1893 | Kampf et al. | 89/43.01 |
| 1,043,890 | A | * | 11/1912 | Yingling et al. | 89/43.02 |
| 1,335,463 | A | * | 3/1920 | Schneider | 89/43.02 |
| 1,845,217 | A | * | 2/1932 | Barnes | 89/43.01 |
| 2,453,855 | A | * | 11/1948 | Ollver | 188/300 |
| H217 | H | * | 2/1987 | Jorczak | 89/43.01 |
| 4,958,706 | A | * | 9/1990 | Richardson et al. | 188/319.1 |
| 5,116,028 | A | * | 5/1992 | Mintgen et al. | 267/64.12 |
| 6,105,987 | A | * | 8/2000 | Turner | 280/276 |

* cited by examiner

*Primary Examiner* — Benjamin P Lee
(74) *Attorney, Agent, or Firm* — Henry S. Goldfine

(57) ABSTRACT

A recoil brake includes a control rod disposed in a central opening in a piston and cylinder assembly. A fluid passage leads from the piston to the control rod. A long stroke body is fixed to the piston and defines a long stroke orifice around the control rod. A short stroke body is removably disposed in the long stroke orifice. The short stroke body defines a short stroke orifice around the control rod, the short stroke orifice being smaller than the long stroke orifice. The recoil brake may be used with a 120 mm gun.

11 Claims, 6 Drawing Sheets

VARIABLE RECOIL BRAKE FOR MUNITION

CROSS REFERENCE TO RELATED APPLICATIONS

This application is a continuation-in-part of U.S. patent application Ser. No. 11/425,812 filed on Jun. 22, 2006 now abandoned and entitled "Variable Recoil Brake for Munition." This application claims the benefit of priority under 35 USC §120 to U.S. patent application Ser. No. 11/425,812, which is expressly incorporated by reference in this application.

STATEMENT OF GOVERNMENT INTEREST

The inventions described herein may be manufactured, used and licensed by or for the U.S. Government for U.S. Government purposes.

BACKGROUND OF THE INVENTION

The invention relates in general to munitions and in particular to recoil brakes for guns.

Recoil brakes for guns, such as artillery and howitzers, absorb recoil force when a gun is fired and limit the travel of the gun during recoil. Some guns, such as launchers, may be elevated to deliver a long-range projectile, i.e., the muzzle end of the gun is higher than the breech end. When the angle of elevation is large, the breech end may strike the deck of the surrounding area during recoil. Thus, it is desirable to have a recoil brake that can shorten the recoil distance of the gun when the angle of elevation is large.

U.S. Pat. No. 1,335,464, issued to Schneider on Mar. 30, 1920, discloses an apparatus for varying the recoil of a gun, and is incorporated by reference herein. FIGS. 1-4 of Schneider illustrate a recoil brake having a short stroke orifice and a long stroke orifice. As noted by Schneider at column 2, lines 1-7, a drawback of the recoil brake shown in FIGS. 1-4 of Schneider is that it is difficult to give to the counter-rod F a shape that is suitable to produce a braking law for both the long recoil and the short recoil. Schneider solves this problem with a complex mechanism that is illustrated in FIGS. 5-15 of Schneider. The mechanism of FIGS. 5-15 requires many additional components, compared to the mechanism shown in FIGS. 1-4 of Schneider. A need exists for a simpler recoil brake that operates suitably for both a long recoil stroke and a short recoil stroke.

SUMMARY OF THE INVENTION

It is an object of the invention to provide a recoil brake that has a variable stroke.

It is another object of the invention to provide a variable stroke recoil brake that is simple to adjust from long stroke to short stroke and vice versa.

A further object of the invention is to provide a variable stroke recoil brake suitable for a 120 mm gun.

One aspect of the invention is a recoil brake that may include a cylinder and a piston disposed in the cylinder for reciprocation therein. A piston rod may be attached to the piston. The piston rod and the piston may have a central opening therethrough. A control rod may be disposed in the central opening in the piston rod and piston.

The control rod may have a diameter that varies along its length substantially in accordance with the following number pairs, wherein the first number in each pair is the axial location along the control rod, in inches, and the second number in each pair is the diameter, in inches, of the control rod at that axial location: (0.00, 0.6250); (0.50, 0.6250); (1.00, 0.6250); (1.50, 0.6250); (2.00, 0.7641); (2.50, 0.9093); (2.75, 0.9150); (3.00, 0.9195); (3.50, 0.9250); (4.00, 0.9270); (4.50, 0.9285); (5.00, 0.9310); (5.50, 0.9335); (6.00, 0.9365); (6.50, 0.9395); (7.00, 0.9425); (7.50, 0.9460); (8.00, 0.9500); (8.50, 0.9540); (9.00, 0.9575); (10.00, 0.9660); (11.00, 0.9750); (12.00, 0.9850); (13.00, 0.9975); (14.00, 1.0150); (15.00, 1.0300); (15.50, 1.0350); (16.00, 1.0420); (16.50, 1.0475); (17.00, 1.0530); (17.50, 1.0560); (18.00, 1.0610); (18.50, 1.0670); (19.00, 1.0750); (19.50, 1.0830); (20.00, 1.0926); (20.50, 1.0999); (21.00, 1.1073); (21.50, 1.1170); (22.00, 1.1300).

An end cap may be rotatably disposed in one end of the cylinder. One end of the control rod may be fixed to the end cap and the other end of the control rod may be free. The recoil brake may include at least one fluid passage from the piston to the control rod. A long stroke body may be fixed to the piston. The long stroke body may define a long stroke orifice around the control rod. The diameter of the long stroke orifice may be about 1.14 inches. A short stroke body may be removably disposed in the long stroke orifice. The short stroke body may define a short stroke orifice around the control rod. The diameter of the short stroke orifice may be about 1.05 inches. Fluid flow through the at least one fluid passage may be selectively directed through one of the long stroke orifice and the short stroke orifice by rotation of the end cap.

The invention will be better understood, and further objects, features, and advantages thereof will become more apparent from the following description of the preferred embodiments, taken in conjunction with the accompanying drawings.

BRIEF DESCRIPTION OF THE DRAWINGS

In the drawings, which are not necessarily to scale, like or corresponding parts are denoted by like or corresponding reference numerals.

DETAILED DESCRIPTION OF THE PREFERRED EMBODIMENTS

Figure 1A:
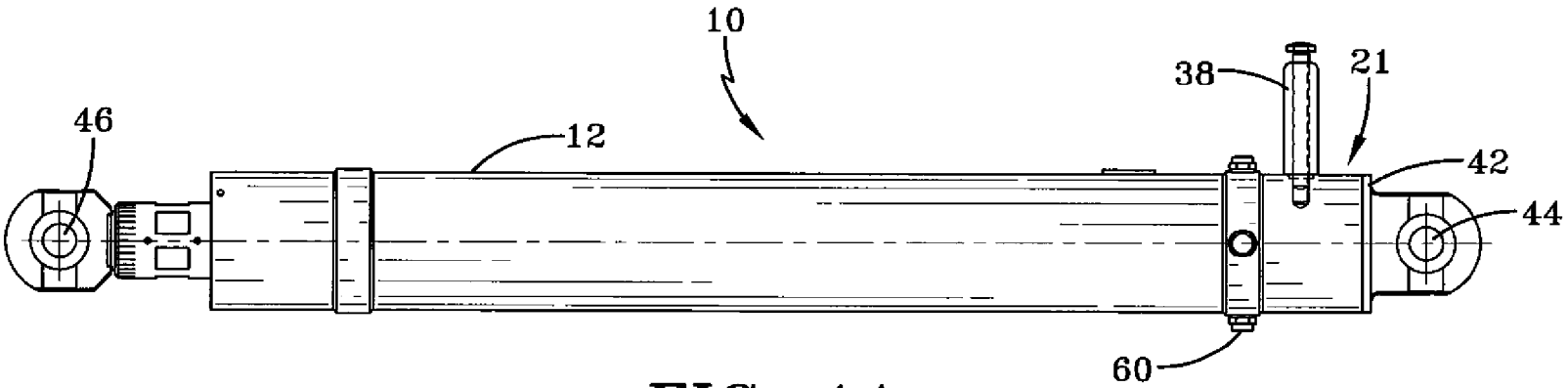
FIG. 1A is a side view of one embodiment of a variable stroke recoil brake in accordance with the invention.

Referring to FIGS. 1A-B and 2A-B, recoil brake 10 includes a cylinder 12, a piston 14 disposed in the cylinder 12 for reciprocation therein and a piston rod 16 attached to the piston 14. The piston rod 16 and piston 14 have a central opening therethrough. A control rod 18 is disposed in the central opening in the piston rod 16 and piston 14. An end cap 20 is rotatably disposed in one end 21 of the cylinder 12. One end 22 of the control rod 18 is fixed to the end cap 20 and the other end 23 of the control rod 18 is free.

Piston 14, piston rod 16 and cylinder 12 define a fluid chamber 25. The working fluid in fluid chamber 25 may be, for example, hydraulic fluid. At least one fluid passage 24 leads from the fluid chamber 25 through the piston 14 to the control rod 18. A long stroke body 27 is fixed to the piston 14. The long stroke body 27 defines a long stroke orifice 26 around the control rod 18, best seen in FIG. 2B.

A short stroke body 28 is removably disposed in the long stroke orifice 26. Short stroke body 28 has a short stroke orifice 30 that is smaller than the long stroke orifice 26. The short stroke body 28 is rotatable with the end cap 20, releasably attached to the cylinder 12 and releasably attached to the long stroke body 27. Fluid flow through the at least one fluid passage 24 may be selectively directed through either the long stroke orifice 26 or the short stroke orifice 30 by rotating the end cap 20. If short stroke recoil is desired, then the fluid flow is directed through the short stroke orifice 30. If long stroke recoil is desired, then the fluid flow is directed through the long stroke orifice 26.

An outer end cap 42 closes one end of cylinder 12. Outer end cap 42 may be fixed to cylinder 12 with threads. An attachment means, for example, a clevis 44, is provided on outer end cap 42. Clevis 44 is attached to either a portion of the gun that recoils, such as the breech ring, or a non-recoil surface, such as the gun mount. At the opposite end of the cylinder 12, another attachment means, for example, a clevis 46, is fixed to the end of the piston rod 16. If clevis 44 is attached to a portion of the gun that recoils, such as the breech ring, then clevis 46 is attached to a non-recoil surface, such as the gun mount, and vice-versa.

Figure 2A:
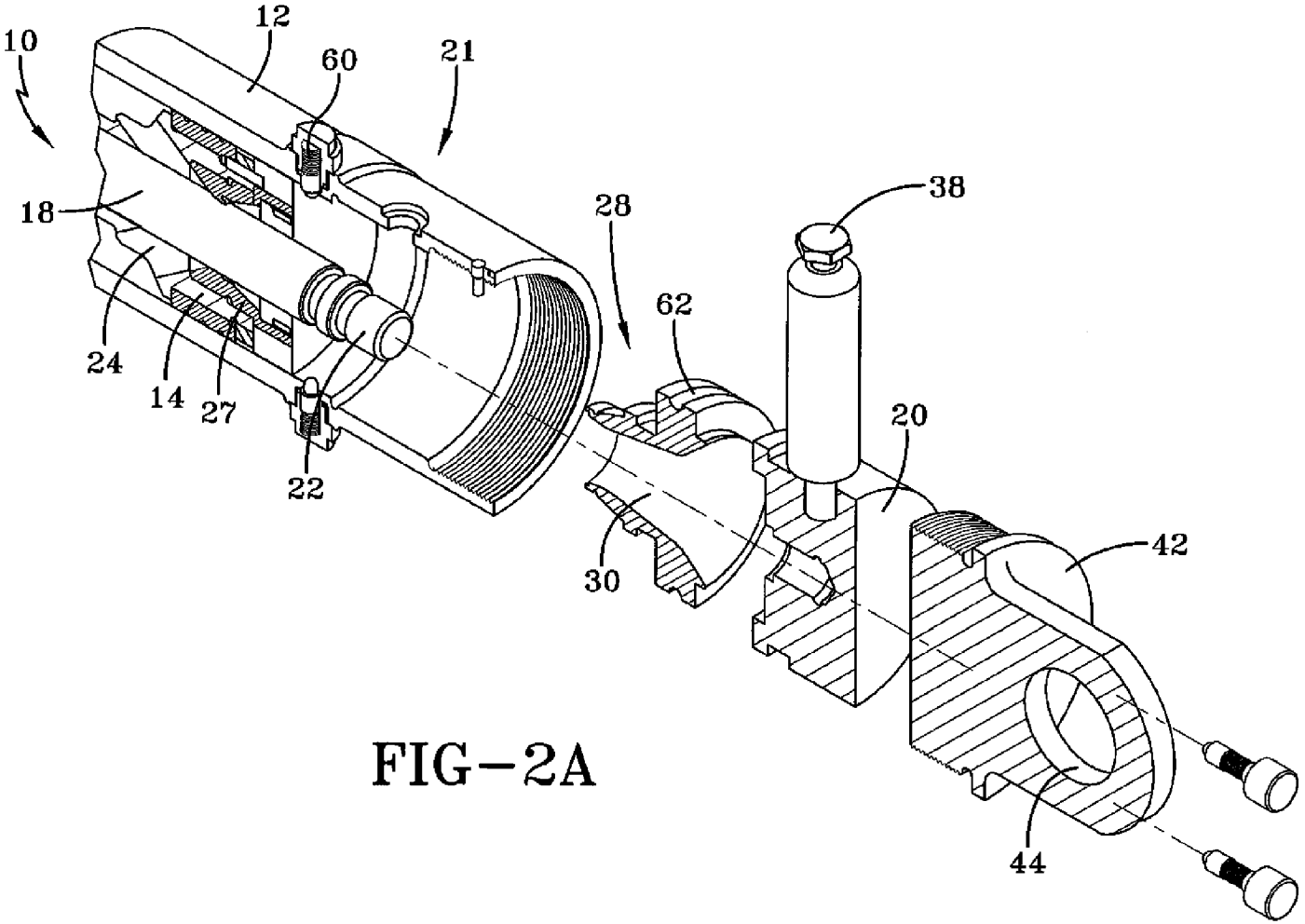
FIG. 2A is an exploded perspective view of the right hand end of FIG. 1A.
Figure 2B:
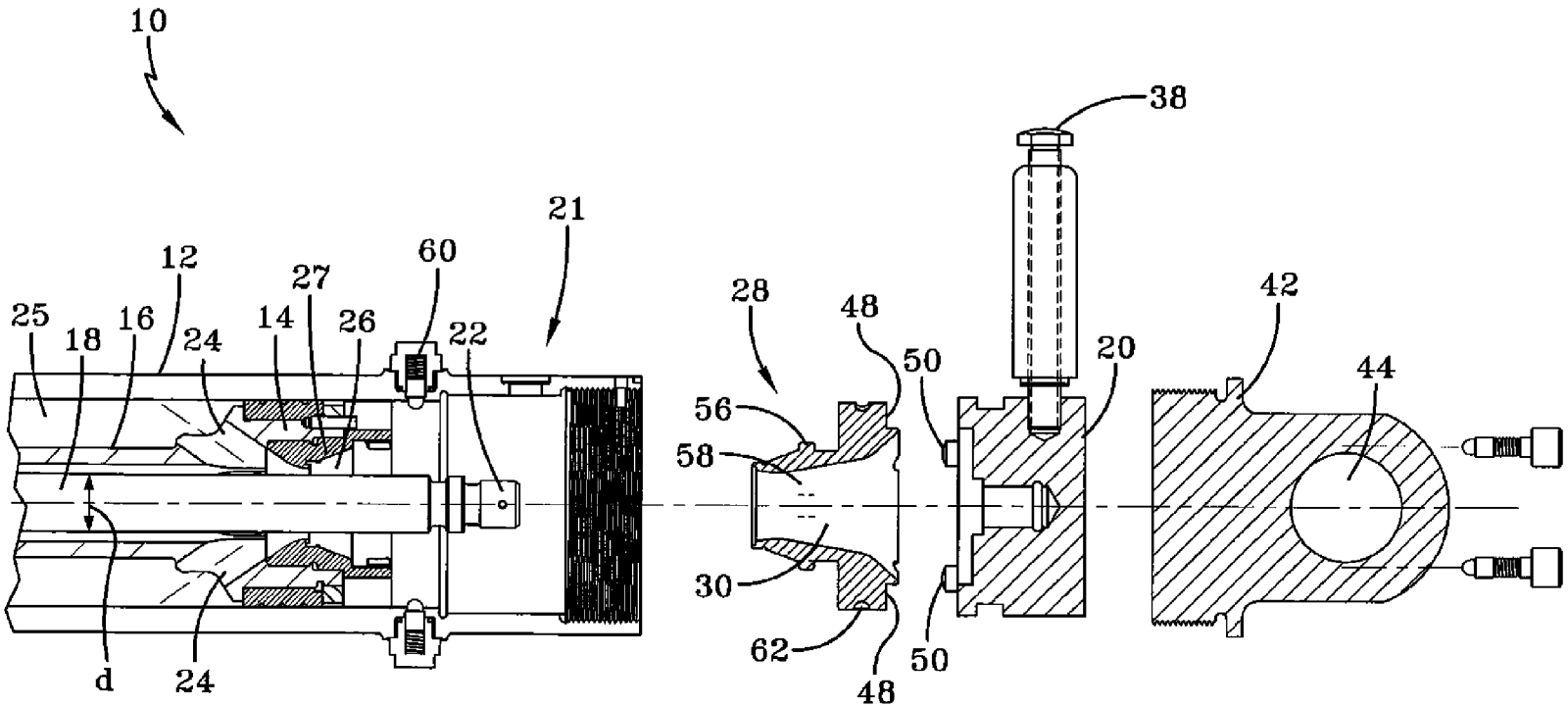
FIG. 2B is a side view of FIG. 2A.
Figure 4A:
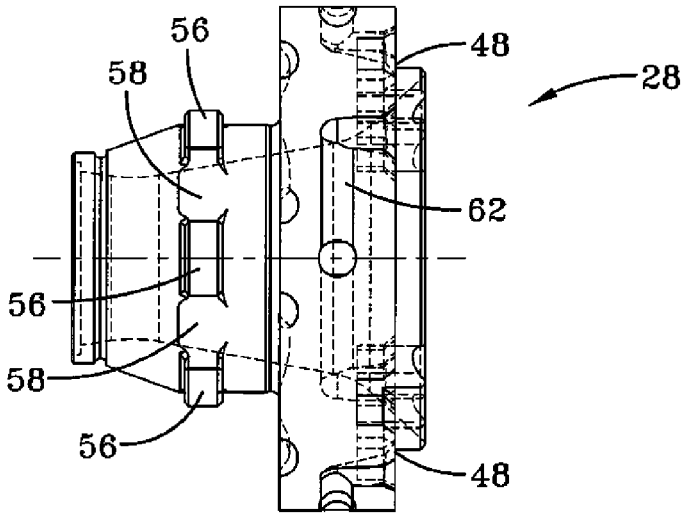
FIG. 4A is a side view of a short stroke orifice body.
Figure 4B:
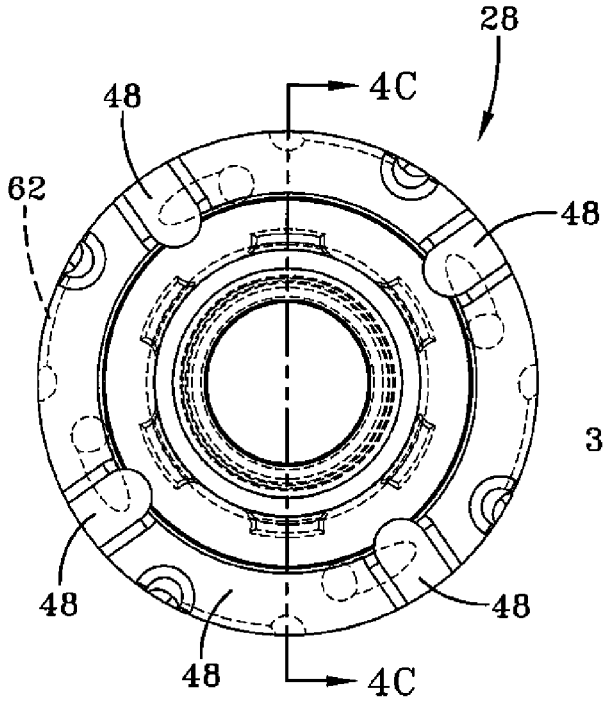
FIG. 4B is an end view of FIG. 4A.
Figure 4C:
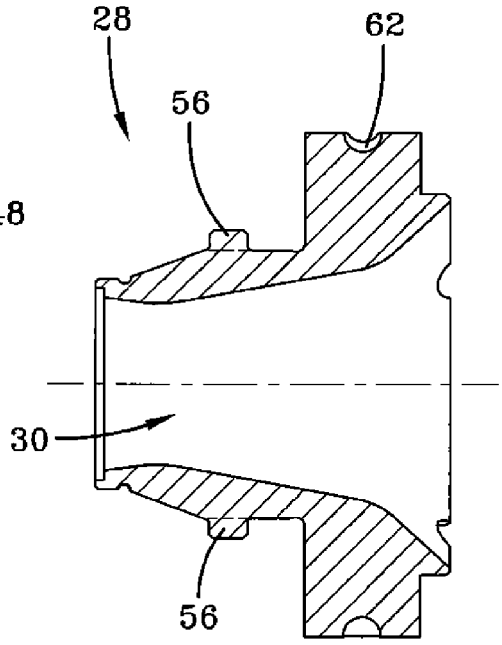
FIG. 4C is a sectional view along the line 4C-4C of FIG. 4B.

End cap 20 fits in cylinder 12 behind outer end cap 42. End cap 20 may partially rotate in cylinder 12 and is sealed against cylinder 12. A handle 38 fastened to the end cap 20 extends outside the cylinder 12, for manually rotating the end cap 20. Short stroke body 28 fits in cylinder 12 behind the end cap 20. Short stroke body 28 is rotatable with end cap 20 via, for example, a clawed connection. The outer circumference of the right hand end (as viewed in FIGS. 4A-C) of the short stroke body 28 includes four slots 48 formed in its face. These slots 48 mate with four bosses 50 (two bosses are shown in FIG. 2B) formed on the outer circumference of the end cap 20. Thus, rotational motion of the end cap 20 is transferred to the short stroke body 28 via the bosses 50 and slots 48. The bosses 50 and slots 48 form the clawed connection between short stroke body 28 and end cap 20.

Figure 3A:
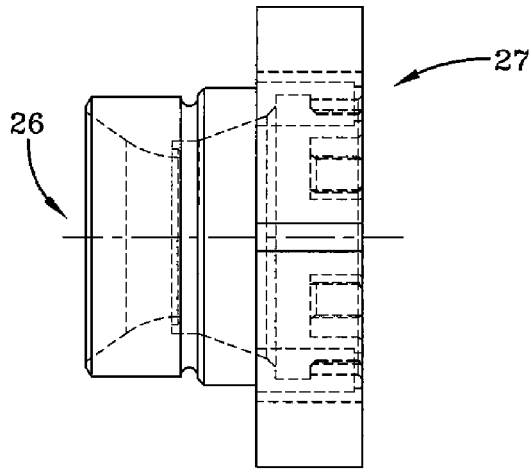
FIG. 3A is a side view of a long stroke orifice body.
Figure 3B:
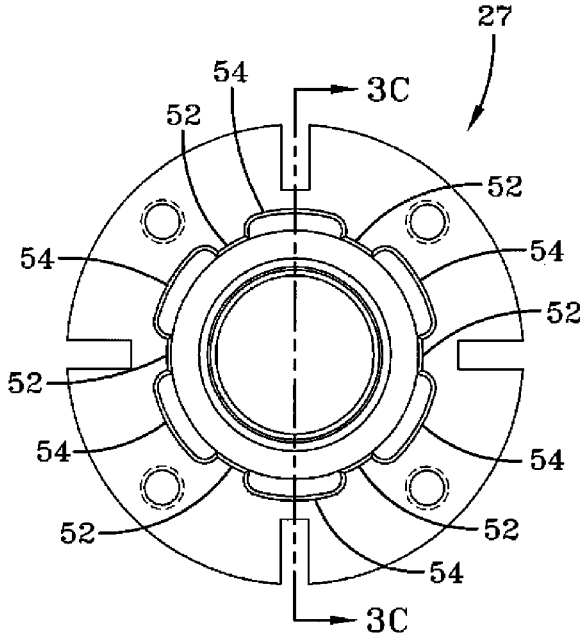
FIG. 3B is an end view of FIG. 3A.
Figure 3C:
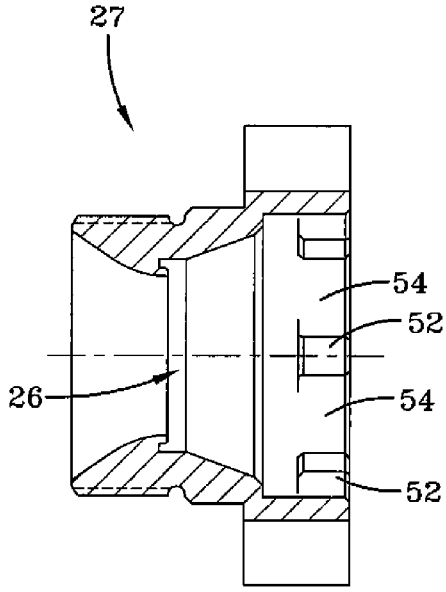
FIG. 3C is a sectional view along the line 3C-3C of FIG. 3B.

The short stroke body 28 is removably disposed in the long stroke orifice 26. Rotation of the short stroke body 28 attaches and releases the short stroke body 28 to the long stroke body 27. The short stroke body 28 is attached to the long stroke body 27 with, for example, a single, zero pitch segmented thread. The long stroke body 27 (FIGS. 3B-C) is internally threaded with thread segments 52 and grooves 54. The short stroke body 28 (FIGS. 4A and 4C) is externally threaded with thread segments 56 and grooves 58. In the rest position, the short stroke body 28 is disposed inside the long stroke orifice 26 (FIG. 1B) such that the thread segments 56 of the short stroke body 28 pass through the grooves 54 of the long stroke body 27. The thread segments 56 of the short stroke body 28 are located to the left of (in FIG. 1B) the grooves 54 of the long stroke body 27. That is, the segments 56 and grooves 54 are in different planes so that they do not "mesh" when the short stroke body 28 rotates.

When short stroke recoil is desired, the rotative position of the short stroke body 28 is such that its thread segments 56 are axially aligned with the thread segments 52 of the long stroke body 27. Then, when the piston 14 and long stroke body 27 move to the left (as seen in FIG. 1B), the thread segments 52 of the long stroke body 27 bear against the thread segments 56 of the short stroke body 28 to thereby "capture" and move the short stroke body 28 axially with the piston 14 and long stroke body 27. Being thus captured, the short stroke orifice 30 remains adjacent the oil passageways 24 in the piston 14. Oil that passes through the piston passageways 24 flows through the short stroke orifice 30, thereby providing short stroke recoil.

If long stroke recoil is desired, the short stroke body 28 is rotated (via handle 38 and end cap 20) so that its thread segments 56 are aligned with the grooves 54 of the long stroke body 27. Then, when the long stroke body 27 moves axially to the left (as seen in FIG. 1B), the thread segments 56 of the short stroke body 28 simply pass through the grooves 54 in the long stroke body 27 and the short stroke body 28 does not move axially. As the long stroke body 27 moves away from the short stroke body 28, the long stroke orifice 26 opens up to receive the fluid from the passageways 24 in the piston 14, thereby providing long stroke recoil. When the recoil brake 10 returns to the rest position again, the short stroke body 28 is again disposed inside the long stroke body 27 with the thread segments 56 aligned with the grooves 54.

Figure 1B:
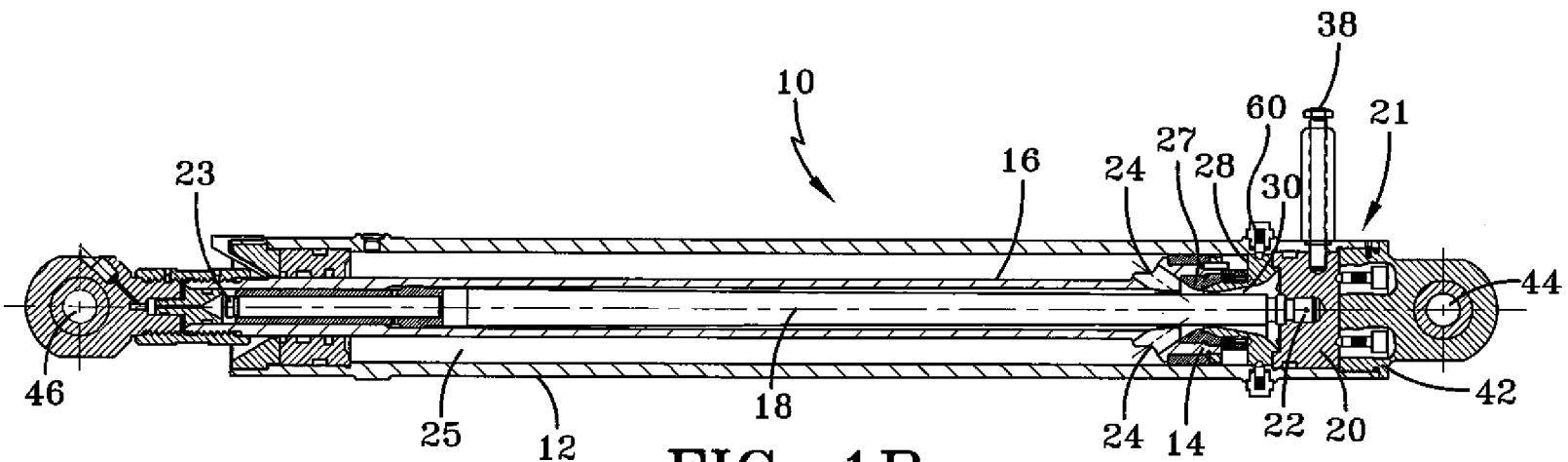
FIG. 1B is a cutaway view of FIG. 1A, partially in section.

The short stroke body 28 is releasably attached to the cylinder 12 with at least one spring loaded pin 60 (FIGS. 1A-B). Pin or pins 60 are circumferentially disposed around cylinder 12 with spring loaded detents that bear against the outer surface of short stroke body 28. The outer surface of short stroke body 28 includes variable depth grooves 62 in which the pins 60 move as the short stroke body 28 is rotated. Handle 38 is used to rotate end cap 20 and, therefore, short stroke body 28 between the short and long stroke positions.

Rather than adding additional control rods and other components to produce braking that is suitable for both short and long recoil, as shown in FIGS. 5-15 of Schneider, the present invention may use a single control rod 18. The successful results obtained with a single control rod 18 were not predictable. In the invention, the diameter d (FIG. 2B) of the control rod 18 may be varied in a non-linear manner along the length of the control rod 18. While there may be an infinite number of possible non-linear profiles for control rod 18, the inventors discovered a rod profile that may produce suitable results for both long and short stroke recoil.

The diameter of rod 18 may be varied along its length. The diameter may be varied beginning at a point "0", near end 22 of rod 18, which may be the beginning of recoil, and ending 22 inches from point 0, near end 23 of rod 18, which may be the end of the long stroke recoil. The diameters (in inches) of rod 18 and the axial locations (in inches) of the diameters are substantially as set forth in the following number pairs, where the first number in each pair is the axial location along the rod 18 and the second number in each pair is the diameter of rod 18 at that axial location: (0.00, 0.6250); (0.50, 0.6250); (1.00, 0.6250); (1.50, 0.6250); (2.00, 0.7641); (2.50, 0.9093); (2.75, 0.9150); (3.00, 0.9195); (3.50, 0.9250); (4.00, 0.9270); (4.50, 0.9285); (5.00, 0.9310); (5.50, 0.9335); (6.00, 0.9365); (6.50, 0.9395); (7.00, 0.9425); (7.50, 0.9460); (8.00, 0.9500); (8.50, 0.9540); (9.00, 0.9575); (10.00, 0.9660); (11.00, 0.9750); (12.00, 0.9850); (13.00, 0.9975); (14.00, 1.0150); (15.00, 1.0300); (15.50, 1.0350); (16.00, 1.0420); (16.50, 1.0475); (17.00, 1.0530); (17.50, 1.0560); (18.00, 1.0610); (18.50, 1.0670); (19.00, 1.0750); (19.50, 1.0830); (20.00, 1.0926); (20.50, 1.0999); (21.00, 1.1073); (21.50, 1.1170); and (22.00, 1.1300).

Figure 5:
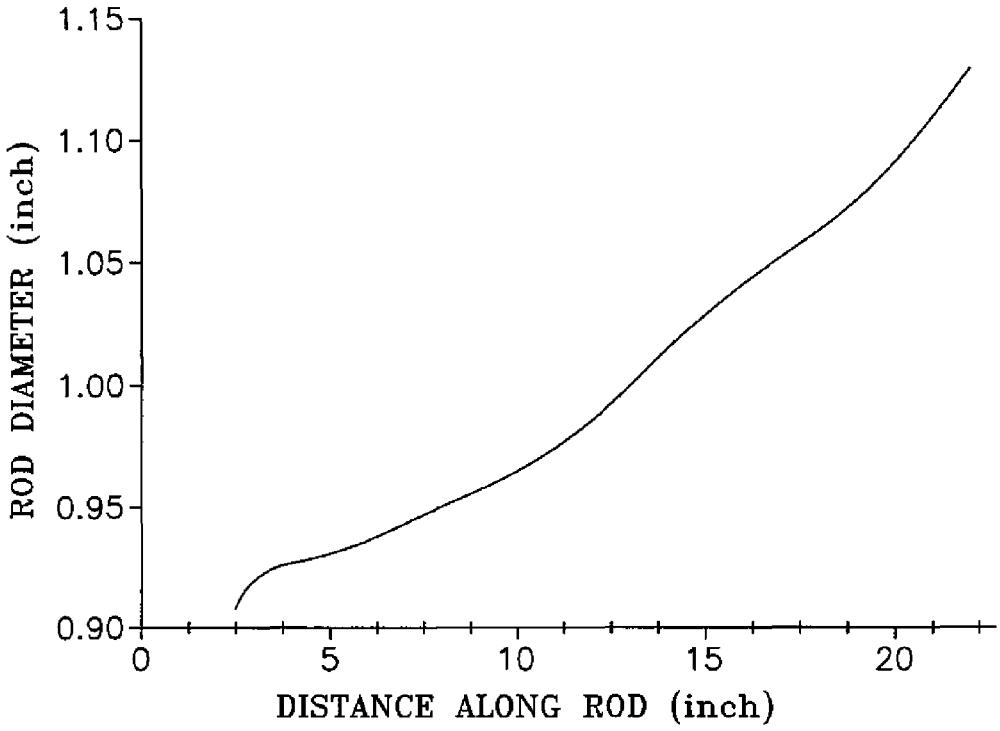
FIG. 5 is a partial plot of rod diameter versus axial position on the rod.
Figure 6:
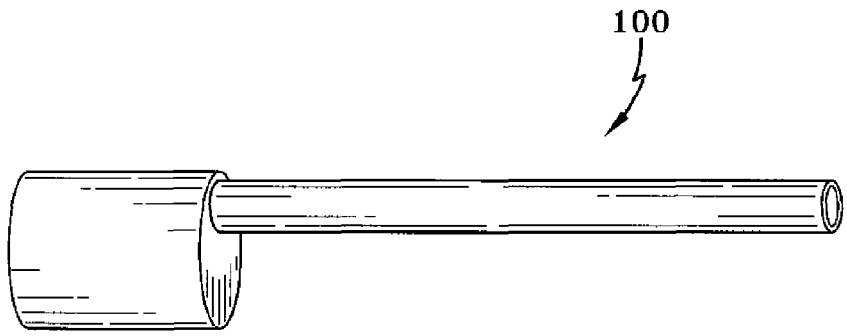
FIG. 6 schematically shows a 120 mm gun.

A graphical representation of a portion of the variation in the diameter of the rod 18 is shown in FIG. 5. Distance "0"

may correspond to the beginning of recoil and may be located toward end 22 of rod 18. Sixteen inches on the x-axis may mark the end of the short stroke recoil. Twenty-two inches on the x-axis may mark the end of the long stroke recoil, toward end 23 of rod 18. For purposes of clarity, the diameters of the rod 18 from 0.00 to about 2.00 inches on the x-axis are not shown.

The diameter of the short stroke orifice 30 may be about 1.05 inches and the diameter of the long stroke orifice 26 may be about 1.14 inches. The recoil brake 10 with control rod 18 may be used with a gun 100 (FIG. 6), such as a 120 mm gun, for example, the XM 360 120 mm gun.

Computerized recoil simulations indicate that the maximum force transferred through the brake 10 with rod 18 may be substantially the same for both the short and long stroke recoils. Also, the maximum force transferred through the brake 10 for both recoil strokes may be about 20% more than the force transferred through a brake having a control rod designed for only short stroke operation.

While the invention has been described with reference to certain preferred embodiments, numerous changes, alterations and modifications to the described embodiments are possible without departing from the spirit and scope of the invention as defined in the appended claims, and equivalents thereof.

What is claimed is:

1. A recoil brake, comprising:

a cylinder;

a piston disposed in the cylinder for reciprocation therein;

a piston rod attached to the piston, the piston rod and piston having a central opening therethrough;

a single control rod which provides both long and short recoil braking, which control rod is disposed in the central opening in the piston rod and piston, the control rod having a diameter that varies along its length substantially in accordance with the following number pairs, wherein a first number in each pair is an axial location along the control rod and a second number in each pair is a diameter of the control rod at that axial location: (0.00, 0.6250); (0.50, 0.6250); (1.00, 0.6250); (1.50, 0.6250); (2.00, 0.7641); (2.50, 0.9093); (2.75, 0.9150); (3.00, 0.9195); (3.50, 0.9250); (4.00, 0.9270); (4.50, 0.9285); (5.00, 0.9310); (5.50, 0.9335); (6.00, 0.9365); (6.50, 0.9395); (7.00, 0.9425); (7.50, 0.9460); (8.00, 0.9500); (8.50, 0.9540); (9.00, 0.9575); (10.00, 0.9660); (11.00, 0.9750); (12.00, 0.9850); (13.00, 0.9975); (14.00, 1.0150); (15.00, 1.0300); (15.50, 1.0350); (16.00, 1.0420); (16.50, 1.0475); (17.00, 1.0530); (17.50, 1.0560); (18.00, 1.0610); (18.50, 1.0670); (19.00, 1.0750); (19.50, 1.0830); (20.00, 1.0926); (20.50, 1.0999); (21.00, 1.1073); (21.50, 1.1170); (22.00, 1.1300);

an end cap rotatably disposed in one end of the cylinder, one end of the control rod being fixed to the end cap and the other end of the control rod being free;

at least one fluid passage from the piston to the control rod;

a long stroke body fixed to the piston, the long stroke body defining a long stroke orifice around the control rod, a diameter of the long stroke orifice being about 1.14 inches; and a short stroke body removably disposed in the long stroke orifice, the short stroke body defining a short stroke orifice around the control rod, a diameter of the short stroke orifice being about 1.05 inches;

wherein fluid flow through the at least one fluid passage may be selectively directed through one of the long stroke orifice and the short stroke orifice by rotation of the end cap.

2. The recoil brake of claim 1 wherein the short stroke body is rotatable with the end cap.

3. The recoil brake of claim 2 wherein the short stroke body is rotatable with the end cap via a clawed connection.

4. The recoil brake of claim 2 wherein the short stroke body is releasably attached to the cylinder.

5. The recoil brake of claim 4 wherein the short stroke body is releasably attached to the long stroke orifice body.

6. The recoil brake of claim 5 wherein the short stroke body is releasably attached to the long stroke orifice body with a zero pitch segmented thread.

7. The recoil brake of claim 4 wherein the short stroke body is releasably attached to the cylinder with at least one spring loaded pin.

8. The recoil brake of claim 1 wherein the end cap includes a handle that extends outside the cylinder, for rotating the end cap.

9. A weapon including the recoil brake of claim 1.

10. The weapon of claim 9, wherein the weapon comprises a 120 mm gun.

11. The weapon of claim 10, wherein the weapon is an XM360.

* * * * *